US007439002B2

(12) United States Patent
Hu et al.

(10) Patent No.: US 7,439,002 B2
(45) Date of Patent: Oct. 21, 2008

(54) IMAGING MEMBERS

(75) Inventors: Nan-Xing Hu, Oakville (CA); John Graham, Oakville (CA); Ah-Mee Hor, Mississauga (CA); Yvan Gagnon, Mississauga (CA); Cheng-Kuo Hsiao, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 310 days.

(21) Appl. No.: 11/179,943

(22) Filed: Jul. 12, 2005

(65) Prior Publication Data

US 2007/0015072 A1 Jan. 18, 2007

(51) Int. Cl.
*G03G 5/147* (2006.01)
*G03G 5/047* (2006.01)

(52) U.S. Cl. ..... 430/66; 430/58.2; 430/58.7; 430/123.42

(58) Field of Classification Search ..... 430/58.2, 430/58.7, 66, 123.42
See application file for complete search history.

(56) References Cited

U.S. PATENT DOCUMENTS 3,121,006 A 2/1964 Middleton et al.
3,590,000 A 6/1971 Palermiti et al.
3,849,182 A 11/1974 Hagenbach
3,900,588 A 8/1975 Fisher
4,264,672 A 4/1981 Taylor-Brown et al.
4,298,697 A 11/1981 Baczek et al.
4,338,390 A 7/1982 Lu
4,558,108 A 12/1985 Alexandru et al.
4,560,535 A 12/1985 Bouchée
4,560,635 A 12/1985 Hoffend et al.
4,996,125 A * 2/1991 Sakaguchi et al. ..... 430/66
5,368,967 A 11/1994 Schank et al.
5,681,679 A 10/1997 Schank et al.
5,702,854 A 12/1997 Schank et al.
5,709,974 A 1/1998 Yuh et al.
2003/0134209 A1 * 7/2003 Itami ..... 430/58.2
2004/0062568 A1 * 4/2004 Nukada et al. ..... 399/159
2006/0154161 A1 * 7/2006 Ql et al. ..... 430/66

* cited by examiner

*Primary Examiner*—Christopher RoDee
*Assistant Examiner*—Peter L Vajda
(74) *Attorney, Agent, or Firm*—Eugene O. Palazzo; Fay Sharpe LLP

(57) ABSTRACT

A silicone overcoat (SOC) layer having a crosslinked polysiloxane composition comprising a perfluoropolyether segment are disclosed. The polysiloxane composition is the product of the hydrolysis and condensation of a SOC formulation comprising a perfluoropolyether compound, an aromatic silicon-containing compound, and a silicon-containing hole transport compound. An electrophotographic imaging member having such a SOC layer has improved properties.

16 Claims, 1 Drawing Sheet

IMAGING MEMBERS

BACKGROUND

The present disclosure is generally directed, in various embodiments, to imaging members and/or components thereof. More particularly, the disclosure relates to various embodiments of crosslinked polysiloxane compositions comprising a perfluoropolyether segment, silicone overcoat (SOC) formulations which form crosslinked polysiloxane compositions comprising a perfluoropolyether segment, SOC layers made from the formulations, and electrophotographic imaging members comprising such crosslinked polysiloxane compositions.

In the art of xerography, or electrophotographic printing/copying, an electrophotographic imaging member, such as a photoreceptor, is electrostatically charged. For optimal image production, the photoreceptor should be uniformly charged across its entire surface. The photoreceptor is then exposed to a light pattern of an input image to selectively discharge the surface of the photoreceptor in accordance with the image. The resulting pattern of charged and discharged areas on the photoreceptor forms an electrostatic charge pattern (i.e., a latent image) conforming to the input image. The latent image is developed by contacting it with finely divided electrostatically attractable powder called toner. Toner is held on the image areas by electrostatic force. The toner image may then be transferred to a substrate or support member, and the image is then affixed to the substrate or support member by a fusing process to form a permanent image thereon. After transfer, excess toner left on the photoreceptor is cleaned from its surface, and residual charge is erased from the photoreceptor.

Electrophotographic photoreceptors can be provided in a number of forms. For example, the photoreceptors can be a homogeneous layer of a single material, such as vitreous selenium, or it can be a composite layer containing a photoconductive layer and another material. In addition, the photoreceptor can be layered. Current layered photoreceptors generally have at least a flexible substrate support layer and two active layers. These active layers generally include a charge generating layer containing a light absorbing material, and a charge transport layer containing electron donor molecules. These layers can be in any order, and sometimes can be combined in a single or a mixed layer. The flexible substrate support layer can be formed of a conductive material. Alternatively, a conductive layer can be formed on top of a nonconductive flexible substrate support layer.

A photoreceptor can be in a rigid drum configuration or in a flexible belt configuration. The belt can be either seamless or seamed.

Typical photoreceptor drums comprise a charge transport layer and a charge generating layer coated over a rigid conducting substrate support drum. For example, many advanced imaging systems are based on the use of small diameter photoreceptor drums. The use of small diameter drums places a premium on photoreceptor life. A major factor limiting photoreceptor life in copiers and printers is wear. The use of small diameter drum photoreceptors exacerbates the wear problem because, for example, 3 to 10 revolutions are required to image a single letter size page. Multiple revolutions of a small diameter drum photoreceptor to reproduce a single letter size page can require up to 1 million cycles from the photoreceptor drum to obtain 100,000 prints, a desirable goal for commercial systems.

For low volume copiers and printers, bias charging rolls (BCR) are desirable because little or no ozone is produced during image cycling. However, the micro corona generated by the BCR during charging, damages the photoreceptor, resulting in rapid wear of the imaging surface, e.g., the exposed surface of the charge transport layer. For example, wear rates can be as high as about 16 μm per 100,000 imaging cycles. Similar problems are encountered with bias transfer roll (BTR) systems. One approach to achieving longer photoreceptor drum life is to form a protective overcoat on the imaging surface, e.g. the charge transporting layer of a photoreceptor. This overcoat layer must satisfy many requirements, including transporting holes, resisting image deletion, resisting wear, and avoidance of perturbation of underlying layers during coating.

For flexible photoreceptor belts, the charge transport layer and charge generating layer are coated on top of a flexible substrate support layer. To ensure that the photoreceptor belts exhibit sufficient flatness, an anticurl backing layer can be coated onto the back side of the flexible substrate support layer to counteract upward curling and ensure photoreceptor flatness. The flexible photoreceptor belts are repeatedly cycled to achieve high speed imaging. As a result of this repetitive cycling, the outermost layer of the photoreceptor experiences a high degree of frictional contact with other machine subsystem components used to clean and/or prepare the photoreceptor for imaging during each cycle. When repeatedly subjected to cyclic mechanical interactions against the machine subsystem components, photoreceptor belts can experience severe frictional wear at the outermost organic photoreceptor layer surface that can greatly reduce the useful life of the photoreceptor. Ultimately, the resulting wear impairs photoreceptor performance and thus image quality.

In U.S. Pat. No. 5,702,854 to Schank et al. issued Dec. 30, 1998, an electrophotographic imaging member is disclosed including a supporting substrate coated with at least a charge generating layer, a charge transport layer and an overcoating layer. The overcoating layer comprises a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

In U.S. Pat. No. 5,681,679 issued to Schank, et al., a flexible electrophotographic imaging member is disclosed including a supporting substrate and a resilient combination of at least one photoconductive layer and an overcoat layer, the at least one photoconductive layer comprising a hole transporting arylamine siloxane polymer and the overcoat comprising a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

Yuh et al. have disclosed an electrophotographic imaging member in U.S. Pat. No. 5,709,974 issued on Jan. 20, 1998. The electrophotographic imaging member includes a charge generating layer, a charge transport layer and an overcoat layer. The transport layer includes a charge transporting aromatic diamine molecule in a polystyrene matrix and the overcoat layer includes a hole transporting hydroxy arylamine compound having at least two hydroxy functional groups and a polyamide film forming binder capable of forming hydrogen bonds with the hydroxy functional groups of the hydroxy arylamine compound.

In U.S. Pat. No. 5,368,967 issued to Schank et al., an electrophotographic imaging member is disclosed comprising a substrate, a charge generating layer, a charge transport layer, and an overcoat layer comprising a small molecule hole transporting arylamine having at least two hydroxy functional groups, a hydroxy or multihydroxy triphenyl methane and a polyamide film forming binder capable of forming hydrogen bonds with the hydroxy functional groups the hydroxy arylamine and hydroxy or multihydroxy triphenyl methane. This overcoat layer may be fabricated using an alcohol solvent. This electrophotographic imaging member may be utilized in an electrophotographic imaging process. Specific materials including Elvamide polyamide and N,N'-diphenyl-N,N'-bis(3-hydroxyphenyl)-[1,1'-biphenyl]-4,4'-diamine and bis-[2-methyl-4-(N-2-hydroxyethyl-N-ethylaminophenyl)]-phenylmethane are disclosed in this patent.

A silicon overcoat (SOC) is a protective layer coated on top of a photoreceptor device. SOC has demonstrated the potential for extrinsic life extension of photoreceptors. Owing to its crosslinked siloxane structure, SOC offers good abrasive, scratching and marring resistance. The SOC is typically prepared by curing a sol-gel type coating solution comprising a silane-containing hole transport molecule and an organic silane matrix binder. While a photoreceptor having a SOC protective layer provides initial satisfactory image quality, its image quality may deteriorate after repeated printing, in particular under a high humid environment. As such, new silicon overcoat compositions are needed to manufacture an electrophotographic imaging member such as a photoreceptor with improved image quality.

BRIEF DESCRIPTION

In one exemplary embodiment, a silicone overcoat (SOC) formulation for an electrophotographic imaging member is provided. The SOC formulation comprises a perfluoropolyether compound, an aromatic silicon-containing compound, and a silicon-containing hole transport compound.

In another exemplary embodiment, a silicone overcoat (SOC) layer for an electrophotographic imaging member is provided. The SOC layer comprises a crosslinked polysiloxane composition containing a perfluoropolyether segment. In one embodiment, the SOC layer includes a product of the hydrolysis and condensation of an SOC formulation. The SOC formulation comprises a perfluoropolyether compound, an aromatic silicon-containing compound, and a silicon-containing hole transport compound.

In another exemplary embodiment, an electrophotographic imaging member, such as a photoreceptor, is provided. The electrophotographic imaging member comprises a substrate, a charge generating layer, a charge transport layer, and a SOC layer. The SOC layer comprises a crosslinked polysiloxane composition containing a perfluoropolyether segment.

In specific embodiments, the silicon-containing hole transport compound comprises a tertiary aromatic amine.

In another exemplary embodiment, an electrophotographic imaging device is provided. The device comprises an imaging member which has an SOC layer.

These and other non-limiting embodiments will be more particularly described with regard to the drawings and detailed description set forth below.

BRIEF DESCRIPTION OF THE DRAWINGS

The following is a brief description of the drawings which is presented for the purposes of illustrating the disclosure set forth herein and not for the purposes of limiting the same.

DETAILED DESCRIPTION

Figure 1:
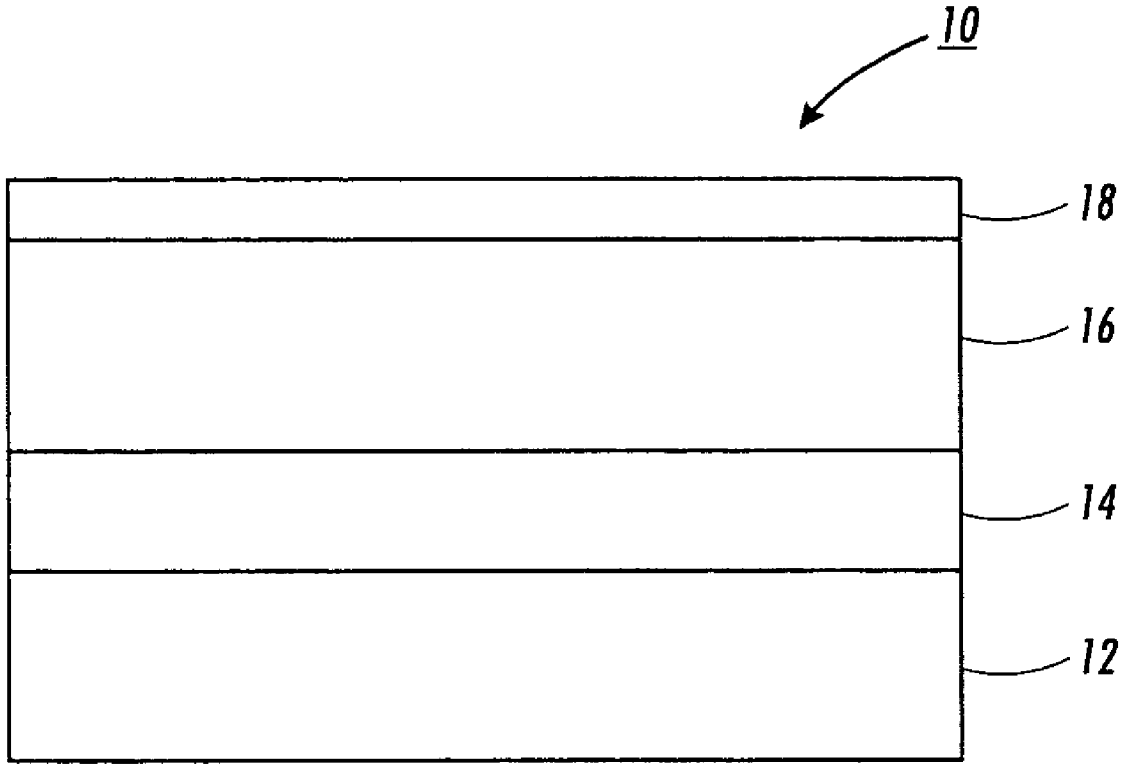
FIG. 1 is a schematic cross-sectional view of a photoconductive imaging member in accordance with the present disclosure.

The present disclosure relates to a photoconductive imaging member comprising an outermost protective layer (or an overcoating layer) containing a perfluoropolyether segment. The imaging member may have various configurations. In an illustrative embodiment, the present disclosure relates to a photoconductive imaging member comprising a substrate, a charge generation layer, a charge transport layer, and an outermost protective layer (or an overcoating layer) disposed over the charge transport layer. The overcoating layer, or overcoat, is an SOC layer which is a crosslinked polysiloxane composition comprising a perfluoropolyether segment. The present disclosure also relates to a process for forming the photoconductive imaging member and the overcoating layer.

Also included within the scope of the present disclosure are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560,635; 4,298,697; and, 4,338,390, the disclosures of which are totally incorporated herein by reference, subsequently transferring the image to a suitable substrate, and permanently affixing the image thereto.

A more complete understanding of the processes and apparatuses disclosed herein can be obtained by reference to the accompanying drawings. These figures are merely schematic representations based on convenience and the ease of demonstrating the present development, and are, therefore, not intended to indicate relative size and dimensions of the imaging members or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to component of like function.

With reference to FIG. 1, a photoconductive imaging member in accordance with the present disclosure is shown. Photoconductive imaging member 10 comprises a substrate 12, a charge generating or photogenerating layer 14, a charge transport layer 16, and an overcoating layer 18. Overcoating layer 18 is a SOC layer which is a crosslinked polysiloxane composition comprising a perfluoropolyether segment.

It is to be understood herein, that if a "range" or "group" is mentioned with respect to a particular characteristic of the present disclosure, for example, percentage, chemical species, and temperature etc., it relates to and explicitly incorporates herein each and every specific member and combination of sub-ranges or sub-groups therein whatsoever. Thus, any specified range or group is to be understood as a shorthand way of referring to each and every member of a range or group individually as well as each and every possible sub-ranges or sub-groups encompassed therein; and similarly with respect to any sub-ranges or sub-groups therein.

In this regard, disclosed herein is a crosslinked polysiloxane composition, or SOC composition, comprising a perfluoropolyether segment. The perfluoropolyether segment comprises a polymer component having a repeating unit of —($C_nF_{2n}O$)—, wherein n is an integer from 1 to about 6. The perfluoropolyether segment is uniformly blended with the rest of the overcoat composition. The perfluoropolyether segment is usually bound to the crosslinked polysiloxane composition either physically or chemically, such as by hydrogen bonding, or chemical bonding.

In exemplary embodiments, the perfluoropolyether segment may be represented by —$(C_nF_{2n}O)_x$—, or a copolymer comprised thereof, wherein n is an integer from 1 to about 6, and x is the number of repeating units ranging from about 2 to about 500. Examples of perfluoropolyether segments may be selected from the group consisting of poly(difluoromethylene oxide), poly(tetrafluoroethylene oxide), poly(hexafluoropropylene oxide), poly(tetrafluoroethylene oxide-co-difluoromethylene oxide), poly(hexafluoropropylene oxide-co-difluoromethylene oxide), and poly(tetrafluoroethylene oxide-co-hexafluoropropylene oxide-co-difluoromethylene oxide). The perfluoropolyether segment typically has a number average molecular weight of from about 100 to about 50,000, or in specific embodiments from about 500 to about 10,000, and in one embodiment of about 2,000. In further embodiments, the perfluoropolyether segment is chemically bound to the crosslinked polysiloxane composition though a hydrogen bond or a covalent bond. The amount of the perfluoropolyether segment in the crosslinked polysiloxane composition may range from about 0.01 to about 10 wt %, including from about 0.05 to about 5 wt %, and from about 0.1 to about 3 wt %, based on the total weight of the crosslinked polysiloxane composition. The crosslinked polysiloxane composition may be included in a SOC layer on an imaging member.

In specific embodiments, the crosslinked polysiloxane composition is the product of the hydrolysis and condensation of a SOC formulation comprising three compounds: a perfluoropolyether compound, an aromatic silicon-containing compound, and a silicon-containing hole transport compound. It should be understood that the polysiloxane composition itself does not contain these three compounds, but their products thereof; however, for the sake of efficiency and clarity, the polysiloxane composition will be described as comprising these three compounds.

The perfluoropolyether compound may be represented by the following Formula (I):

$$(C_fF_{2f}O)_x\text{-}[G]_p \qquad \text{Formula (I)}$$

wherein f is an integer from 1 to about 6; x is an integer from about 2 to about 500; G is a functional group connected to the end of the perfluoropolyether chain or grafted to the polymer backbone thereof; p is an integer from 1 to about 100; and G is a binding group, which may be selected from the group consisting of —OH, —$CH_2OH$, —$CH_2(OCH_2CH_2)_kOH$, —$CH_2OCH_2CH(OH)CH_2OH$, —$CO_2H$, —$SiE_q(Y)_{3-q}$, and —$(CH_2)_dSiE_q(Y)_{3-q}$, where E is alkyl having from 1 to 6 carbon atoms, q is an integer from 0 to 2, d is an integer from 1 to about 6, and Y is selected from the group consisting of hydroxy, acetoxy, alkoxy having from 1 to 6 carbon atoms, and halide.

In a specific embodiment, the perfluoropolyether compound of Formula (I) is FLUOROLINK S-10, available from Solvay Solexis, Inc. FLUOROLINK S-10 is a perfluoropolyether with ethoxysilane terminal groups. This may correspond to a compound represented by Formula (I) wherein G is —$SiE_q(Y)_{3-q}$, or —$(CH_2)_dSiE_q(Y)_{3-q}$ and Y is ethoxy. In another specific embodiment, Y is alkoxy having from 1 to 6 carbon atoms.

The aromatic silicon-containing compound may be represented by Formula (II) and the silicon-containing hole transport compound may be represented by Formula (III):

$$A\text{-}[L\text{-}SiR_nX_{3-n}]_m \qquad \text{Formula (II)}$$

$$B\text{-}[L\text{-}SiR_nX_{3-n}]_m \qquad \text{Formula (III)}$$

wherein A is a multiple-valent organic group; B is a hole transport moiety; L is independently a divalent linkage; R is independently selected from alkyl, arylalkyl, aryl, and alkylaryl; X is independently a hydrolytic group; m is independently an integer from 1 to 6; and n is independently an integer from 0 to 2. The m, n, L, R, and X of Formulas (II) and (III) are independently selected; however, because they are each selected from the same ranges or groups, they are described together.

In embodiments, the X of Formulas (II) and (III) are independently selected from the group consisting of hydroxyl, alkoxy having from 1 to 6 carbon atoms, acetoxy, and halide. In specific embodiments X is independently selected from methoxy, ethoxy, propoxy or isopropoxy.

In embodiments, the R of Formulas (II) and (III) are independently selected from the group consisting of alkyl having from 1 to about 6 carbon atoms and phenyl. In specific embodiments, R is independently methyl or ethyl.

In exemplary embodiments, the divalent linkages L of Formulas (II) and (III) are independently selected from the group consisting of:

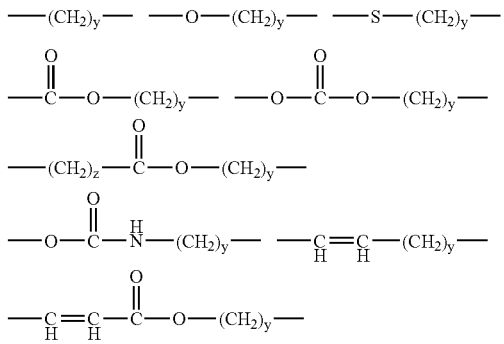

wherein y is an integer from 1 to about 6 and z is an integer from 1 to about 6.

A of Formula (II) is a multiple-valent organic group having at least one bonding site to bond to the silyl components of Formula (II). In embodiments, A has m bonding sites for bonding to the m silyl components. In exemplary embodiments, A is selected from the group consisting of:

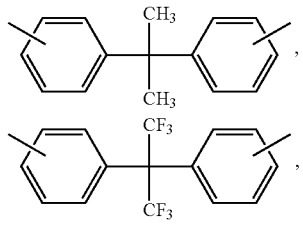

-continued
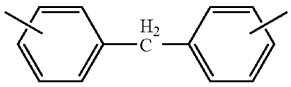
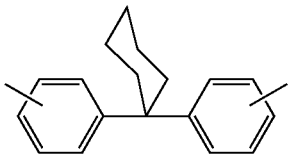
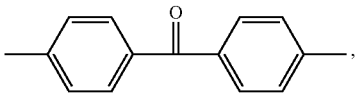
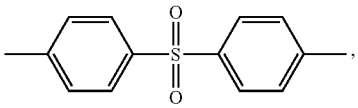
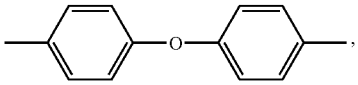
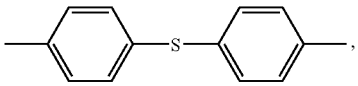
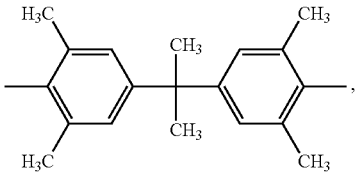
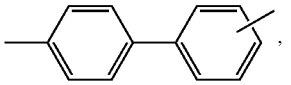
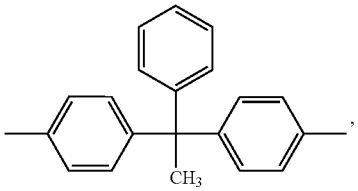
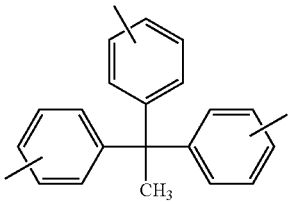
-continued
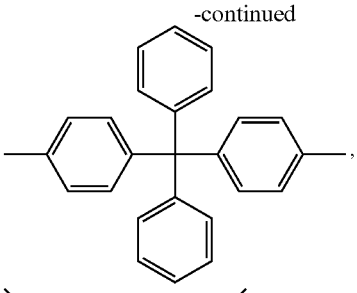
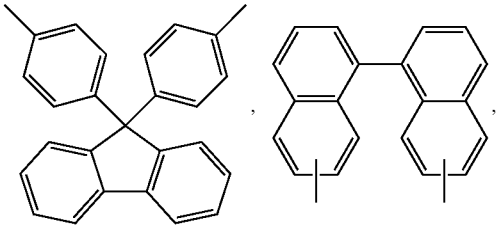
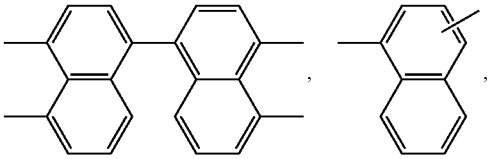
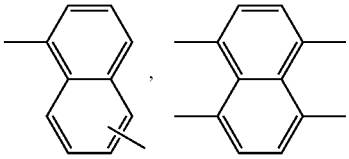
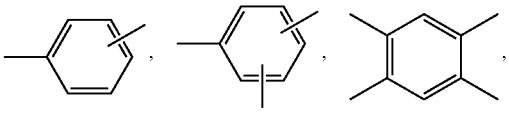
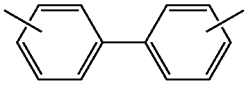
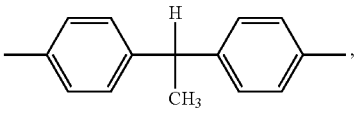
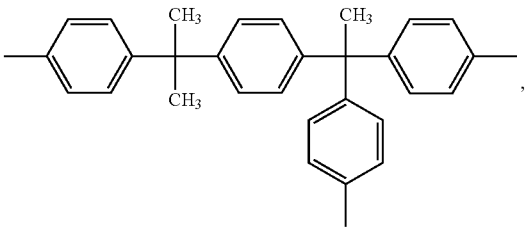
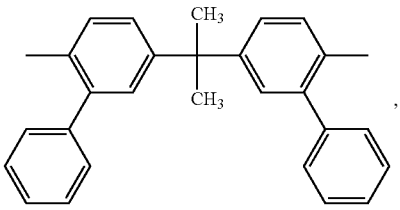

-continued
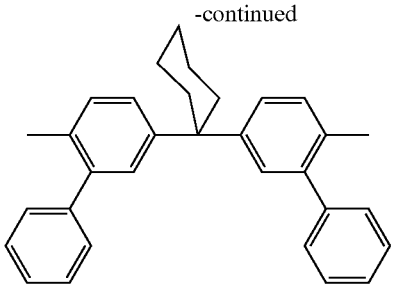
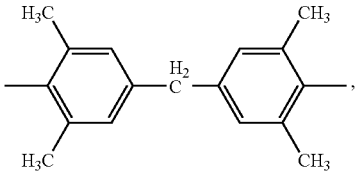
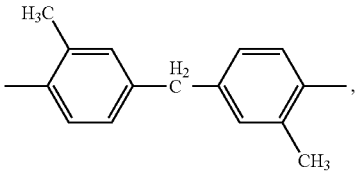
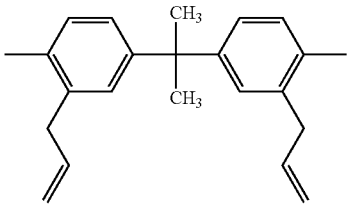
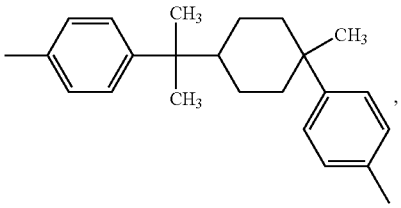
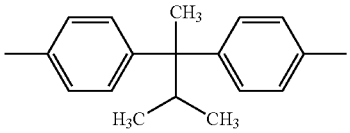
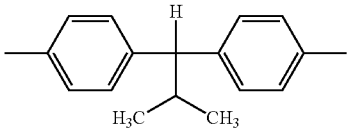
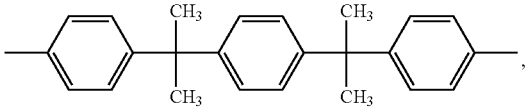
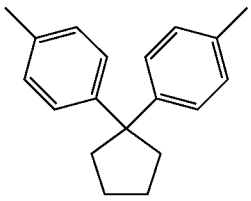
-continued
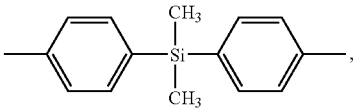
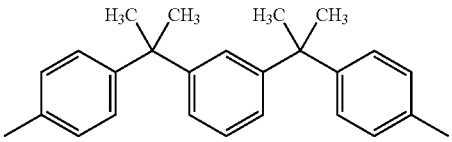
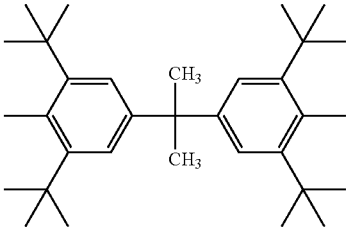
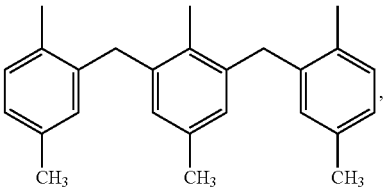
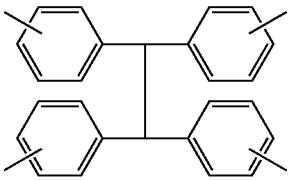
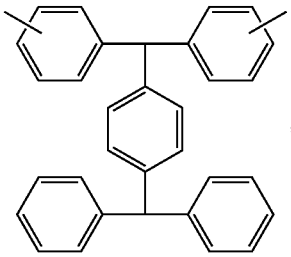
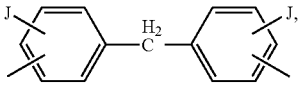
(wherein J is F, Cl, Br or $NO_2$)
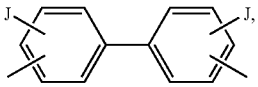
(wherein J is F, Cl, Br or $NO_2$)
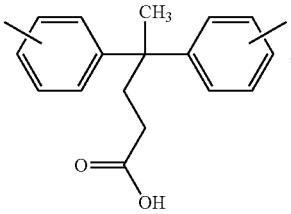
and -continued

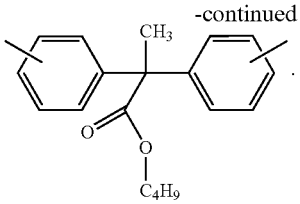

In specific embodiments, the aromatic silicon-containing compound of Formula (III) is selected from the group consisting of the following Formulas (II-1), (II-2), and (II-3):

Formula (II-1)

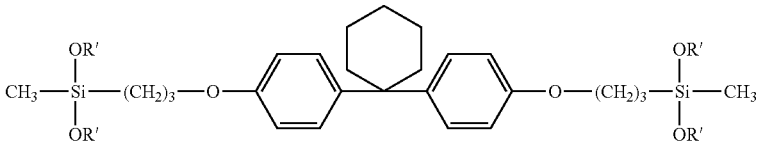

Formula (II-2)

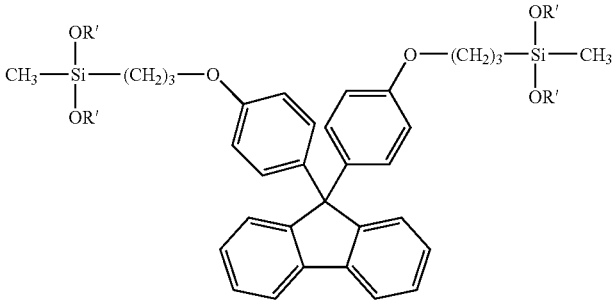

Formula (II-3)

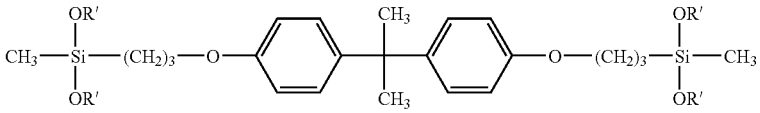

wherein R' is alkyl having from 1 to about 4 carbon atoms. In more specific embodiments, R' is isopropyl.

The aromatic silicon-containing compound of Formula (II) is present in the crosslinked polysiloxane composition in an amount of from about 10 to about 80 wt %, including from about 30 to about 70 wt %, based on the total weight of the crosslinked polysiloxane composition.

B of Formula (III) represents a hole transport moiety. Any hole transport compound known in the prior art may be selected for B. In exemplary embodiments, the hole transport moiety is a tertiary aromatic amine represented by Formula (IV):

Formula (IV)

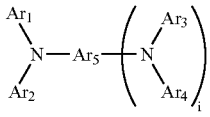

wherein $Ar_1$, $Ar_2$, $Ar_3$, and $Ar_4$ are independently any substituted or unsubstituted aryl group; $Ar_5$ is a substituted or unsubstituted aryl or arylene group; i is 0 or 1; and at least one of $Ar_1$, $Ar_2$, $Ar_3$, $Ar_4$, and $Ar_5$ offers a bonding site to connect with the silyl component of Formula (III). In embodiments, $Ar_1$, $Ar_2$, $Ar_3$, $Ar_4$, and $Ar_5$ together have m bonding sites for connecting with the m silyl components.

In specific embodiments, the silicon-containing hole transport compound of Formula (III) is selected from the group consisting of:

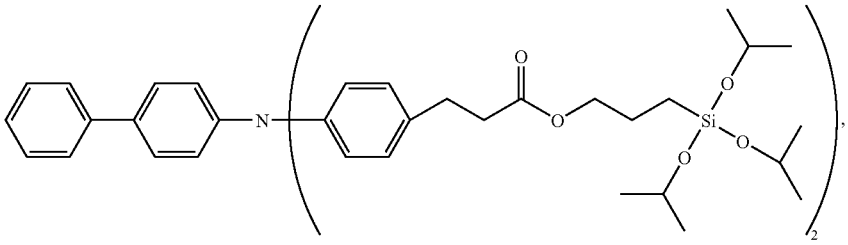
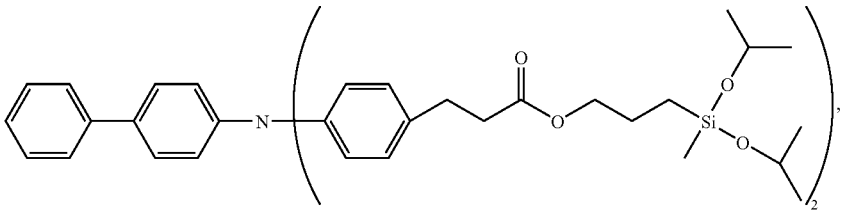
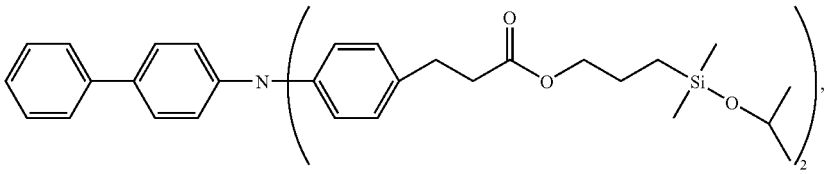
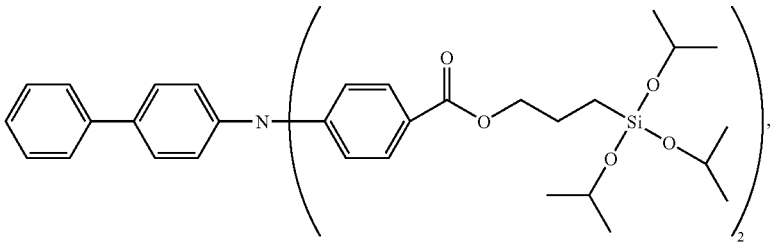
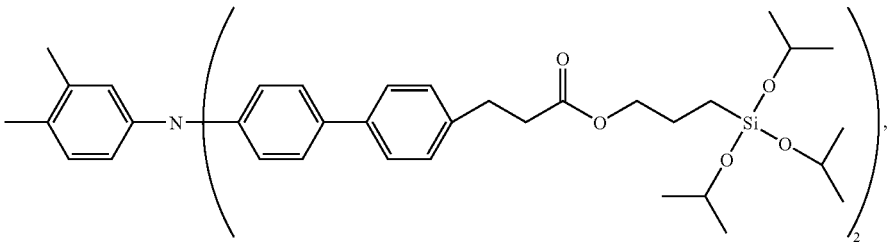
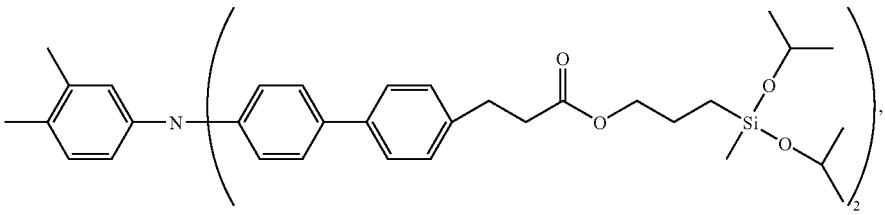
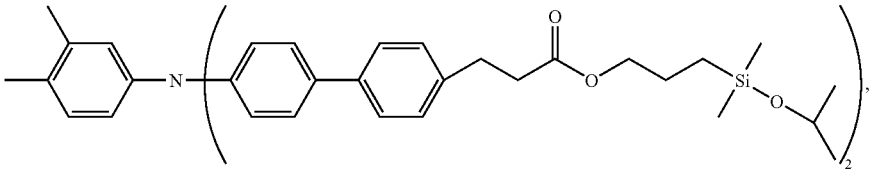

-continued
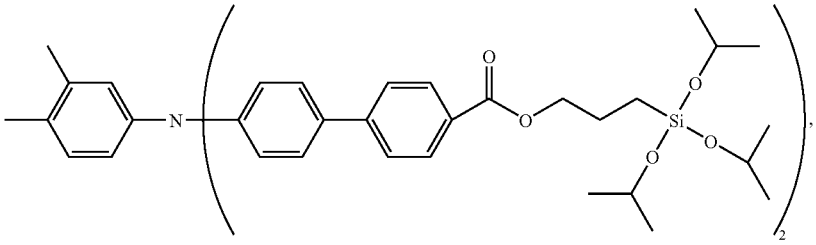
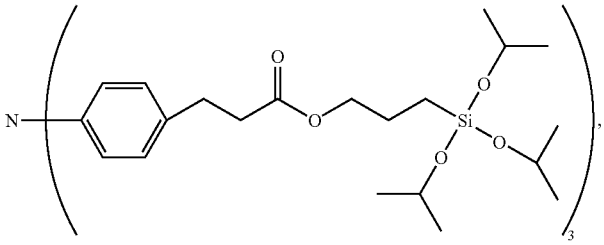
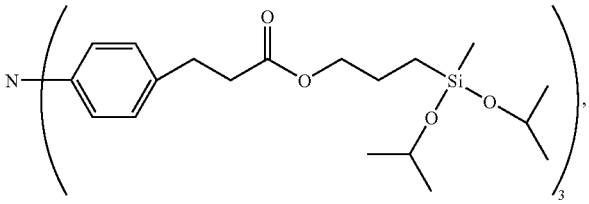
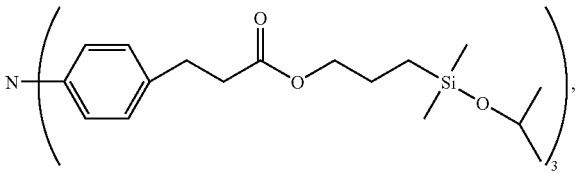
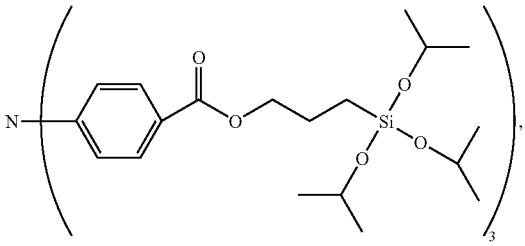
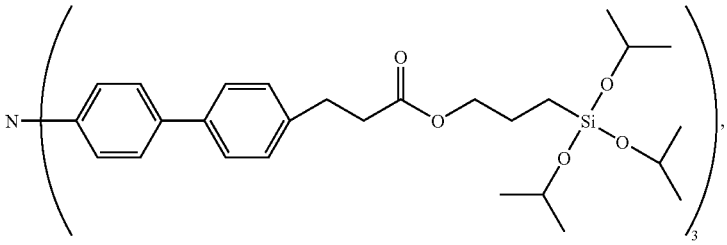
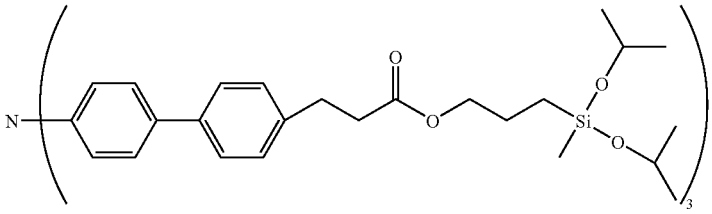
and -continued

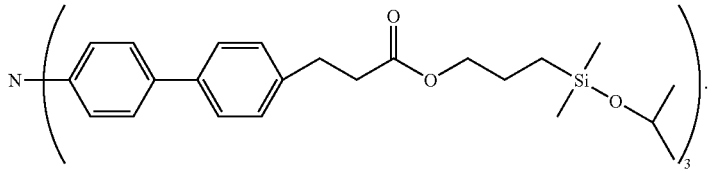

In a exemplary embodiment, the silicon-containing hole transport compound of Formula (III) is the compound shown below, sometimes designated as Ae-93, and represented by Formula (III-1):

Formula (III-1)

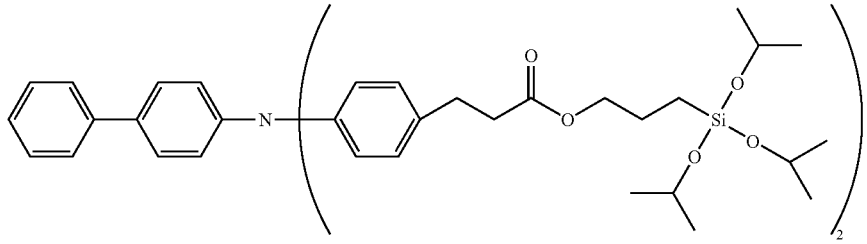

The silicon-containing hole transport compound of Formula (III) is present in the crosslinked polysiloxane composition in an amount of from about 20 to about 90 wt %, including from about 30 to about 70 wt %, or from about 40 to about 60 wt %, based on the total weight of the crosslinked polysiloxane composition.

In other embodiments according to the present disclosure, the crosslinked polysiloxane composition further comprises a polymeric resin. Illustrative examples of such polymer resin include a polyvinyl acetal resin such as a polyvinyl butyral resin, a polyvinyl formal resin or a partially acetalized polyvinyl acetal resin in which butyral is partially modified with formal or acetoacetal, a polyamide resin, a cellulose resin such as ethyl cellulose, a melamine-formaldehyde resin, and a phenol resin. These resins may be used either alone or in combination.

Typically, the polymer resin that may be used in a crosslinked polysiloxane composition of the present disclosure comprises polyvinyl butyral (PVB). The expression "polyvinyl butyral", as employed herein, is defined as a copolymer or terpolymer obtained from the hydrolysis of polyvinyl acetate to form polyvinyl alcohol or a copolymer of polyvinyl alcohol with residual vinyl acetate groups, the resulting polyvinyl alcohol polymer being reacted with butyraldehyde under acidic conditions to form polyvinyl butyral polymers with various amounts of acetate, alcohol and butyraldehyde ketal groups. These polyvinyl butyral polymers are commercially available from, for example, Solutia Inc. with the trade names: BMS, BLS, BL1, B79, B99, and the like. These polymers differ in the amount of acetate, hydroxy, and butyraldehyde ketal groups contained therein. Generally, the weight average molecular weights of polyvinyl butyral vary from about 36,000 to about 98,000. A typical alcohol soluble polyvinyl butyral polymer can be represented by the following formula:

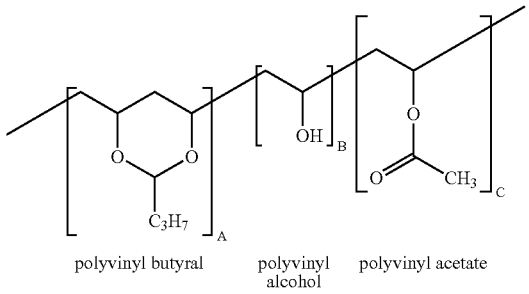

In the above formula, A is a number such that polyvinyl butyral content in the polymer is from about 50 to about 88 mol percent; B is a number such that polyvinyl alcohol content in the polymer is from about 12 to about 50 mol percent; and C is a number such that polyvinyl acetate content in the polymer is from about 0 to about 15 mol percent. These PVB polymers are commercially available and include, for example, Butvar B-79 resin (available from Monsanto Chemical Co.) having a polyvinyl butyral content of about 70 mol percent, a polyvinyl alcohol content of 28 mol percent and a polyvinyl acetate content of less than about 2 mol percent, a weight average molecular weight of from about 50,000 to about 80,000; Butvar B-72 resin (available from Monsanto Chemical Co.) having a polyvinyl butyral content of about 56 mol percent by weight, a polyvinyl alcohol content of 42 mol percent and a polyvinyl acetate content of less than about 2 mol percent, a weight average molecular weight of from about 170,000 to about 250,000; and BXL polyvinyl butyral resin (available from Sekisui Chemical).

The amount of polymer resin present in the crosslinked polysiloxane composition may range from about 1 to about 30 wt %, including from about 2 to about 20 wt %, and from about 5 to about 10 wt %, based on the total weight of the crosslinked polysiloxane composition.

A skilled artisan is aware that oxidation of any hole transport compound or moiety present in the SOC layer may occur due to, for example, the effects of the corotron effluents. An antioxidant is usually incorporated into the crosslinked polysiloxane composition. Suitable antioxidants include, for example, hindered phenols such as butylated hydroxytoluene (BHT), hindered amines, and the like. Exemplary hindered phenol antioxidants include, but are not limited to, Sumilizer BHT-R, Sumilizer MDP-S, Sumilizer BBM-S, Sumilizer WX-R, Sumilizer NW, Sumilizer BP-76, Sumilizer BP-101, Sumilizer GA-80, Sumilizer GM and Sumilizer GS (the above are manufactured by Sumitomo Chemical Co., Ltd.), IRGANOX 1010, IRGANOX 1035, IRGANOX 1076, IRGANOX 1098, IRGANOX 1135, IRGANOX 1141, IRGANOX 1222, IRGANOX 1330, IRGANOX 1425WL, IRGANOX 1520L, IRGANOX 245, IRGANOX 259, IRGANOX 3114, IRGANOX 3790, IRGANOX 5057 and IRGANOX 565 (the above are manufactured by Ciba Specialty Chemicals), and Adecastab AO-20, Adecastab AO-30, Adecastab AO-40, Adecastab AO-50, Adecastab AO-60, Adecastab AO-70, Adecastab AO-80 and Adecastab AO-330 (the above are manufactured by Asahi Denka Co., Ltd.). Exemplary hindered amine antioxidants include, but are not limited to, Sanol LS2626, Sanol LS765, Sanol LS770, Sanol LS744, Tinuvin 144, Tinuvin 622LD, Mark LA57, Mark LA67, Mark LA62, Mark LA68, Mark LA63 and Sumilizer TPS. Exemplary thioether antioxidants include, but are not limited to, Sumilizer TP-D. Exemplary phosphite antioxidants include, but are not limited to, Mark 2112, Mark PEP 8, Mark PEP 24G, Mark PEP 36, Mark 329K and Mark HP 10 etc.

In a specific embodiment, the antioxidant is butylated hydroxytoluene (BHT). The antioxidant may be present in the crosslinked polysiloxane composition in an amount of from about 0.5 to about 10 wt %, including from about 0.8 to about 5 wt %, and from about 1 to about 3 wt %, based on the total weight of the crosslinked polysiloxane composition.

The crosslinked polysiloxane composition (or SOC layer) can be prepared conventionally. A process for forming such a SOC layer comprises preparing a coating solution from a formulation comprising the compounds of Formulas (I), (II), and (III), then coating the coating solution onto the surface of a photoconductive member and curing the coated layer.

Specifically, a coating solution can be prepared from the polymerization of a formulation comprising the compounds of Formulas (I), (II), and (III) in an organic solvent. Typical organic solvents of the present disclosure include, but are not limited to, water, butanol, propanol, isopropanol, ethanol, methanol, and the like, and mixtures thereof. The polymerization of the coating solution can be accelerated in the presence of a catalyst. For example, the catalysts may include an inorganic acid such as hydrochloric acid, phosphoric acid or sulfuric acid; an organic acid such as formic acid, acetic acid, propionic acid, oxalic acid, p-toluenesulfonic acid, benzoic acid, phthalic acid or maleic acid; and an alkali catalyst such as potassium hydroxide, sodium hydroxide, calcium hydroxide, ammonia or triethylamine and the like. Preferably, a solid catalyst is used for the polymerization as it can be removed readily from the coating solution after the polymerization is completed. Suitable solid catalysts include, but are not limited to, cation exchange resins such as AMBERLITE 14, AMBERLITE 200C and AMBERLIST 15E (the above are manufactured by Rohm & Haas Co.), DOWEX MWC-1-H, DOWEX 88 and DOWEX HCR-W2 (the above are manufactured by Dow Chemical Co.), LEVATIT SPC-108 and LEVATIT SPC-118 (the above are manufactured by Bayer AG), DIAION RCP-150H (manufactured by Mitsubishi Chemical Corporation), SUMIKAION KC470, DUOLITE C26-C, DUOLITE C-433 and DUOLITE 464 (the above are manufactured by Sumitomo Chemical Co., Ltd.), and NAFION H (manufactured by E.I. DuPont de Nemours and Company); anionic exchange resins such as AMBERLITE IRA-400 and AMBERLITE IRA-45 (the above are manufactured by Rohm & Haas Co.).

The coating solution thus prepared may be blended with aforementioned the polymer resins and antioxidants. For purpose of improving, e.g., pot life of the coating solution, a stabilizer such as multidentate ligand may be added. Exemplary multidentate ligands include, but are not limited to, didentate ligands, for example, β-diketone such as acetylacetone, trifluoroacetylacetone, hexafluoroacetylacetone or dipivaloylmethylacetone, an acetoacetate such as methyl acetoacetate and ethyl acetoacetate, bipyridine and derivatives thereof, glycine and derivatives thereof, ethylenediamine and derivatives thereof, 8-oxyquinoline and derivatives thereof, salicylaldehyde and derivatives thereof, catechol and derivatives thereof, and a 2-oxyazo compound; tridentate ligands such as diethyltriamine and derivatives thereof, and nitriloacetic acid and derivatives thereof; and hexadentate ligands such as ethylenediaminetetraacetic acid (EDTA) and derivatives thereof.

A curing agent may also be added into the coating solution in order to facilitate the curing process. Suitable curing agents include a metal chelate compound. Exemplary metal chelate compounds include, but are not limited to, organic aluminum compound such as aluminum triethylate, aluminum triisopropylate, aluminum tri(sec-butyrate), mono(sec-butoxy)aluminum diisopropylate, diisopropoxyaluminum (ethylacetoacetate), aluminum tris(ethylacetoacetate), aluminum bis (ethylacetoacetate) monoacetylacetonate, aluminum tris (acetylacetonate), aluminum diisopropoxy(acetylacetonate), aluminum isopropoxy-bis(acetylacetonate), aluminum tris (trifluoroacetylacetonate), aluminum tris(hexafluoroacetylacetonate), and the like. Other exemplary metal chelate compounds include, but are not limited to, organic tin compounds such as dibutyltin dilaurate, dibutyltin dioctylate, and dibutyltin diacetate etc.; organic titanium compounds such as titanium tetrakis(acetylacetonate), titanium bis(butoxy)bis (acetylacetonate) and titanium bis(isopropoxy)bis(acetylacetonate) etc.; and zirconium compounds such as zirconium tetrakis(acetylacetonate), zirconium bis(butoxy)bis(acetylacetonate) and zirconium bis(isopropoxy)bis(acetylace-tonate) etc.

Any suitable and conventional coating method can be used to coat the coating solution onto the surface. Suitable coating methods include spraying, dip coating, roll coating, wire wound rod coating, and the like. The coated polysiloxane layer can be subjected to further curing at elevated temperatures ranging from about 50 to about 200° C., including 80 to about 150° C. The thickness of the crosslinked polysiloxane composition, or the SOC layer, may range from about 0.5 to 10 micrometers. A typical thickness is from about 1 micrometer to about 5 micrometers.

The disclosure further provides an electrophotographic imaging member such as photoreceptor comprising a substrate, a charge generating layer, a charge transport layer, and a SOC layer made from the SOC formulation as described above.

Electrophotographic imaging members may be prepared by any suitable techniques that are well known in the art. Typically, a flexible or rigid substrate is provided with an electrically conductive surface. A charge generating layer is then applied to the electrically conductive surface. A charge blocking layer or undercoat layer may optionally be applied to the electrically conductive surface prior to the application of a charge generating layer, for example, when an organic photoreceptor is to be fabricated. If desired, an adhesive layer may be utilized on top of the charge blocking layer. Usually the charge generating layer is applied onto the blocking layer and a charge transport layer is formed on the charge generation layer; however, the charge generating layer may be placed on top of or below the charge transport layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like, which are flexible as thin webs. An electrically conducting substrate may be any metal, for example, aluminum, nickel, steel, copper, and the like; or a polymeric material, as described above, filled with an electrically conducting substance, such as carbon, metallic powder, and the like; or an organic electrically conducting material. The electrically insulating or conductive substrate may be in the form of an endless flexible belt, a web, a rigid cylinder, a sheet, and the like.

The thickness of the substrate layer depends on numerous factors, including strength desired and economical considerations. For an electrophotographic imaging member such as a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be generally from about 20 angstroms to about 750 angstroms, and typically from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer or undercoat may be applied to the substrate. Any suitable and conventional blocking layer capable of forming an electronic barrier to holes between the adjacent photoconductive layer and the underlying conductive surface of a substrate may be utilized.

Any suitable adhesive layer well known in the art may optionally be applied to the hole blocking layer or undercoat layer. Typical adhesive layer materials include, for example, polyesters, polyurethanes, and the like. Satisfactory results may be achieved with adhesive layer thickness from about 0.05 micrometer (500 angstroms) to about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

At least one electrophotographic imaging layer is formed on the adhesive layer, blocking layer or substrate. The electrophotographic imaging layer may be a single layer that performs both charge generating and charge transport functions as is well known in the art or it may comprise multiple layers such as a charge generating layer and charge transport layer.

The charge generating layer may comprise amorphous films of selenium and alloys of selenium and arsenic, tellurium, germanium and the like, hydrogenated amorphous silicon and compounds of silicon and germanium, carbon, oxygen, nitrogen, and the like fabricated by, for example, vacuum evaporation or deposition. The charge generating layer may also comprise inorganic pigments of crystalline selenium and its alloys; Group II-VI compounds; and organic pigments and dyes such as quinacridones, polycyclic pigments such as dibromo anthanthrone pigments, perylene and perinone diamines, polynuclear aromatic quinones, azo pigments including bis-, tris- and tetrakis-azos; quinoline pigments, indigo pigments, thioindigo pigments, bisbenzimidazole pigments, phthalocyanine pigments, quinacridone pigments, lake pigments, azo lake pigments, oxazine pigments, dioxazine pigments, triphenylmethane pigments, azulenium dyes, squalium dyes, pyrylium dyes, triallylmethane dyes, xanthene dyes, thiazine dyes, cyanine dyes, and the like dispersed in a film forming polymeric binder and fabricated by solvent coating techniques.

In an embodiment, phthalocyanines may be employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, for example, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

Any suitable polymeric film forming binder material may be employed as the matrix in the charge generating (photogenerating) layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

A photogenerating composition or pigment may be present in the resinous binder composition in various amounts. Generally, however, from about 5 percent to about 90 percent by volume of the photogenerating pigment is dispersed in about 10 percent to about 95 percent by volume of the resinous binder, and typically from about 20 percent to about 30 percent by volume of the photogenerating pigment is dispersed in about 70 percent to about 80 percent by volume of the resinous binder composition. The charge generating layer can also fabricated by vacuum sublimation in which case there is no binder.

Any suitable and conventional technique may be utilized to mix and thereafter apply the charge generating layer coating mixture. Typical application techniques include spraying, dip coating, roll coating, wire wound rod coating, vacuum sublimation and the like. For some applications, the charge generating layer may be fabricated in a dot or line pattern. Removing of the solvent of a solvent coated layer may be effected by any suitable conventional technique such as oven drying, infrared radiation drying, air drying and the like.

The charge transport layer may comprise a charge transporting molecule, typically small molecule, dissolved or molecularly dispersed in a film forming electrically inert polymer such as a polycarbonate. The term "dissolved" is defined herein as forming a solution in which the molecules are dissolved in the polymer to form a homogeneous phase. The expression "molecularly dispersed" used herein is defined as a charge transporting small molecule dispersed in the polymer, the small molecules being dispersed in the polymer on a molecular scale.

Any suitable charge transporting or electrically active small molecule may be employed in the charge transport layer of this disclosure. The expression charge transporting "small molecule" is defined herein as a monomer that allows the free charge photogenerated in the transport layer to be transported across the transport layer.

Typical charge transporting molecules include, but are not limited to, pyrene, carbazole, hydrazone, oxazole, oxadiazole, pyrazoline, arylamine, arylmethane, benzidine, thiazole, stilbene and butadiene compounds; pyrazolines such as 1-phenyl-3-(4'-diethylaminostyryl)-5-(4'-diethylamino phenyl)pyrazoline; diamines such as N,N'-diphenyl-N,N'-bis(3-methylphenyl)-(1,1'-biphenyl)-4,4'-diamine; hydrazones such as N-phenyl-N-methyl-3-(9-ethyl)carbazyl hydrazone and 4-diethyl amino benzaldehyde-1,2-diphenyl hydrazone; oxadiazoles such as 2,5-bis(4-N,N'-diethylaminophenyl)-1,2,4-oxadiazole; poly-N-vinylcarbazole, poly-N-vinylcarbazole halide, polyvinyl pyrene, polyvinylanthracene, polyvinylacridine, a pyrene-formaldehyde resin, an ethylcarbazole-formaldehyde resin, a triphenylmethane polymer and polysilane, and the like.

In an embodiment of the present disclosure, to avoid cycle-up in machines with high throughput, the charge transport layer may be substantially free (less than about two percent) of triphenyl methane. As indicated above, suitable electrically active small molecule charge transporting compounds are dissolved or molecularly dispersed in electrically inactive polymeric film forming materials. An exemplary small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material.

In an embodiment, the charge transport layer may contain an active aromatic diamine molecule, which enables charge transport, dissolved or molecularly dispersed in a film forming binder. The charge transport layer is disclosed in U.S. Pat. No. 4,265,990, the entire disclosure of which is incorporated herein by reference.

Any suitable electrically inactive resin binder insoluble in alcoholic solvent used to apply the overcoat layer may be employed in the charge transport layer. Typical inactive resin binders include polycarbonate resin, polyester, polyarylate, polyacrylate, polyether, polysulfone, and the like. Molecular weights can vary, for example, from about 20,000 to about 150,000. Exemplary binders include polycarbonates such as poly(4,4'-isopropylidene-diphenylene)carbonate (also referred to as bisphenol-A-polycarbonate); polycarbonate; poly(4,4'-cyclohexylidinediphenylene)carbonate (referred to as bisphenol-Z polycarbonate); poly(4,4'-isopropylidene-3,3'-dimethyl-diphenyl)carbonate (also referred to as bisphenol-C-polycarbonate); and the like.

Any suitable charge transporting polymer may also be utilized in the charge transporting layer of this disclosure. The charge transporting polymer should be insoluble in the alcohol solvent employed to apply the overcoat layer. These electrically active charge transporting polymeric materials should be capable of supporting the injection of photogenerated holes from the charge generation material and be incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is from about 10 to about 50 micrometers, but thicknesses outside this range can also be used. A hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of a hole transport layer to the charge generating layer is typically maintained from about 2:1 to 200:1 and in some instances as great as 400:1. Typically, a charge transport layer is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

The electrophotographic imaging member, such as a photoreceptor, according to the present disclosure may be incorporated into various imaging systems such as those conventionally known as xerographic imaging devices or electrophotographic image forming devices. Additionally, the imaging members may be selected for imaging and printing systems with visible, near-red and/or infrared light. In this embodiment, the imaging members may be negatively or positively charged, exposed to light having a wavelength of from about 700 to about 900, such as generated by solid state layers, e.g., arsenide-type lasers, either sequentially or simultaneously, followed by developing the resulting image and transferring it to a print substrate such as transparency or paper. Additionally, the imaging members may be selected for imaging and printing systems with visible light. In this embodiment, the imaging members may be negatively or positively charged, exposed to light having a wavelength of from about 400 to about 700 nanometers, followed by development with a known toner, and then transferring and fixing of the image on a print substrate.

In an embodiment, an apparatus, such as an electrophotographic image forming device, may comprise the electrophotographic imaging member as discussed above, a charging device, an electrostatic image forming station, an image developing station, and an image transfer station.

In an embodiment, the electrophotographic image forming device may be used to generate images with the electrophotographic imaging member such as photoreceptor disclosed herein. Generally, the imaging member may be first charged with a corona charging device such as a corotron, dicorotron, scorotron, pin charging device, bias charging roll (BCR) or the like. Then, a latent electrostatic image is generated on the imaging member with an electrostatic image forming device. Subsequently, the latent electrostatic image is developed by known developing devices at one or more developing stations that apply developer compositions such as, for example, compositions comprised of resin particles, pigment particles, additives including charge control agents and carrier particles, etc., reference being made to, for example, U.S. Pat. Nos. 4,558,108; 4,560,535; 3,590,000; 4,264,672; 3,900,588 and 3,849,182, the disclosures of each of these patents being totally incorporated herein by reference. The developed electrostatic image is then transferred to a suitable print substrate such as paper or transparency at an image transfer station, and affixed to the substrate. Development of the image may be achieved by a number of methods, such as cascade, touchdown, powder cloud, magnetic brush, and the like.

Transfer of the developed image to a print substrate may be by any suitable method, including those wherein a corotron or a biased roll is selected. The fixing step may be performed by means of any suitable method, such as flash fusing, heat fusing, pressure fusing, vapor fusing, and the like.

Following transfer of the developed image from the imaging member surface, the imaging member may be cleaned of any residual developer remaining on the surface, and also cleaned of any residual electrostatic charge prior to being subjected to charging for development of a further or next image.

Specific embodiments of the disclosure will now be described in detail. These examples are intended to be illustrative, and the disclosure is not limited to the materials, conditions, or process parameters set forth in these embodiments. All parts and percentages are by weight unless otherwise indicated.

EXAMPLE 1

An electrophotographic photoreceptor was prepared in the following manner. A coating solution for an undercoat layer comprising 100 parts of a ziconium compound (trade name: Orgatics ZC540), 10 parts of a silane compound (trade name: A110, manufactured by Nippon Unicar Co., Ltd), 400 parts of isopropanol solution and 200 parts of butanol was prepared. The coating solution was applied onto a cylindrical Al substrate subjected to honing treatment by dip coating, and dried by heating at 150° C. for 10 minutes to form an undercoat layer having a film thickness of 0.1 micrometer.

A 0.5 micron thick charge generating layer was subsequently dip coated on top of the undercoat layer from a dispersion of Type V hydroxygallium phthalocyanine (12 parts), alkylhydroxy gallium phthalocyanine (3 parts), and a vinyl chloride/vinyl acetate copolymer, VMCH (Mn=27,000, about 86 weight percent of vinyl chloride, about 13 weight percent of vinyl acetate and about 1 weight percent of maleic acid) available from Dow Chemical (10 parts), in 475 parts of n-butylacetate.

Subsequently, a 20 μm thick charge transport layer (CTL) was dip coated on top of the charge generating layer from a solution of N,N'-diphenyl-N,N'-bis(3-methylphenyl)-1,1'-biphenyl-4,4'-diamine (82.3 parts), 2.1 parts of 2,6-Di-tert-butyl-4-methylphenol (BHT) from Aldrich and a polycarbonate, PCZ-400 [poly(4,4'-dihydroxy-diphenyl-1-1-cyclohexane), $M_w$=40,000] available from Mitsubishi Gas Chemical Company, Ltd. (123.5 parts) in a mixture of 546 parts of tetrahydrofuran (THF) and 234 parts of monochlorobenzene. The CTL was dried at 115° C. for 60 minutes.

An SOC formulation was prepared as follows:

Step 1. 5.8 parts of a compound of Formula (II-1) as shown below, 11 parts of a compound of Formula (III-1) as shown below, and 11 parts of methanol were mixed, and 2 parts of an ion exchange resin (AMBERLIST H15) were added thereto, followed by stirring for 2 hours.

compound of Formula (II-1)

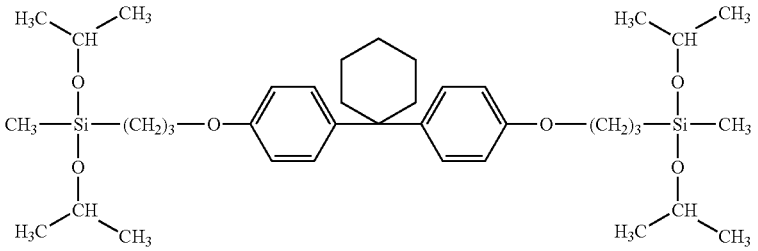

-continued

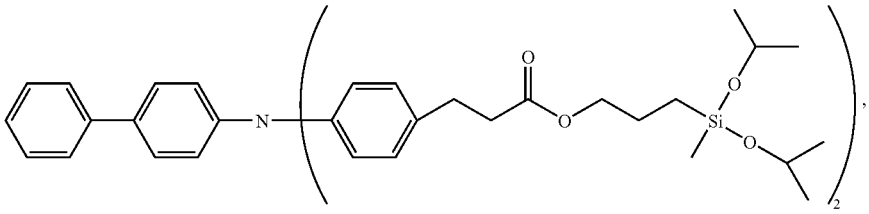

compound of Formula (III-1)

Step 2. 32 parts of butanol and 4.92 parts of distilled water were added to the mixture, followed by stirring at room temperature for 30 minutes. Then, the resulting mixture was filtered to remove the ion exchange resin.

Step 3. 0.180 parts of aluminum trisacetylacetonate ($Al(AcAc)_3$), 0.180 parts of acetylacetone (AcAc), 2 parts of a polyvinyl butyral resin (trade name: BX-L, manufactured by Sekisui Chemical Co., Ltd.), 0.0180 parts of butylated-hydroxytoluene (BHT), 0.261 parts of a hindered phenol antioxidant (IRGANOX 1010), and 0.06 parts of FLUOROLINK S-10 (a perfluoropolyether purchased from Solvay Solexis, Inc.) were added to the filtrate obtained in Step 2 and thoroughly dissolved therein for 2 hours to obtain a coating solution for a SOC layer. The coating solution thus prepared was applied onto a charge transfer layer by dip coating and dried by heating at 130° C. for one hour to form the protective layer having a film thickness of 3 μm, thereby obtaining a desired electrophotographic photoreceptor.

EXAMPLES 2-4

Electrophotographic photoreceptors having a crosslinked polysiloxane overcoat were prepared according to the procedures of Example 1, except that various amounts of FLUOROLINK S-10 were added in Step 1 and Step 3 during the preparation of the overcoat coating solution. The amounts added are summarized in Table 1 below.

TABLE 1

| | Parts of FLUOROLINK S-10 added | | |
|---|---|---|---|
| | Step 1 | Step 3 | Total |
| Example 2 | 0.06 | 0 | 0.06 |
| Example 3 | 0 | 0.1 | 0.1 |
| Example 4 | 0.06 | 0.06 | 0.12 |

EXAMPLES 5-8

Electrophotographic photoreceptors having a crosslinked polysiloxane overcoat were prepared according to the procedures of Example 1, except that the compound of Formula (II-1) was replaced with a compound of Formula (II-2) as shown below, and various amounts of FLUOROLINK S-10 were added in Step 1 and Step 3 during the preparation of the overcoat coating solution. The amounts of FLUOROLINK S-10 added are summarized in Table 2 below.

TABLE 2

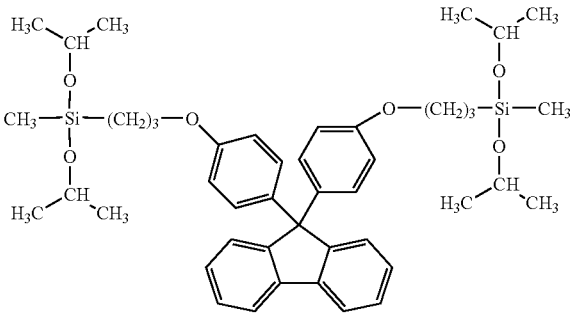

compound of Formula (II-2)

| | Parts of FLUOROLINK S-10 added | | |
|---|---|---|---|
| | Step 1 | Step 3 | Total |
| Example 5 | 0.06 | 0 | 0.06 |
| Example 6 | 0 | 0.06 | 0.06 |
| Example 7 | 0 | 0.1 | 0.1 |
| Example 8 | 0.06 | 0.06 | 0.12 |

COMPARATIVE EXAMPLES 1 & 2

Two comparative examples were prepared according to the procedures of Example 1, except that no FLUOROLINK S-10 was used. The compound of Formula (II-1) and the compound of Formula (II-2) were used for Comparative Example 1 and Comparative Example 2 respectively.

The image quality of the electrophotographic photoreceptors of Examples 1-8 were evaluated in comparison with Comparative Examples 1 and 2. The print tests were carried out in a printing machine under the same conditions (for example, 28° C. and 85% relative humidity). The initial image quality and the image quality after 10,000 prints were analyzed. The results are shown below in Table 3.

TABLE 3

| | Image quality (initial) | Image quality (after 5,000 prints) |
|---|---|---|
| Comparative Example 1 | Good | Poor image occurred |
| Example 1 | Good | Good |
| Example 2 | Good | Good |
| Example 3 | Good | Good |
| Example 4 | Good | Good |
| Comparative Example 2 | Good | Poor image occurred |
| Example 5 | Good | Good |
| Example 6 | Good | Good |
| Example 7 | Good | Good |
| Example 8 | Good | Good |

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

The invention claimed is:

1. An electrophotographic imaging member having a silicone overcoat (SOC) layer, the SOC layer including a crosslinked polysiloxane composition and having a thickness of from about 1 micrometer to about 5 micrometers, wherein the crosslinked polysiloxane composition is the product of the hydrolysis and condensation of a SOC formulation comprising a perfluoropolyether compound represented by Formula (I), an aromatic silicon-containing compound represented by Formula (II), and a silicon-containing hole transport compound represented by Formula (III):

$$(C_fF_{2f}O)_x\text{-}[G]_p \qquad \text{Formula (I)}$$

$$B\text{-}[L\text{-}SiR_nX_{3-n}]_m \qquad \text{Formula (III)}$$

wherein f is an integer from 1 to about 6; x is an integer from about 2 to about 500; G is a functional group connected to the end of the perfluoropolyether chain or grafted to the polymer backbone thereof; p is an integer from 1 to about 100; and G is selected from the group consisting of —OH, $—CH_2OH$, $—CH_2(OCH_2CH_2)_kOH$, $—CH_2OCH_2CH(OH)CH_2OH$, $—CO_2H$, $—SiE_q(Y)_{3-q}$, and $—(CH_2)_dSiE_q(Y)_{3-q}$, where E is alkyl having from 1 to 6 carbon atoms, q is an integer from 0 to 2, d is an integer from 1 to about 6, and Y is selected from the group consisting of hydroxy, acetoxy, alkoxy having from 1 to 6 carbon atoms, and halide; B is a hole transport moiety; L is a divalent linkage; R is selected from alkyl, arylalkyl, aryl, and alkylaryl; X is a hydrolytic group; m is an integer from 1 to 6; and n is an integer from 0 to 2; and wherein the aromatic silicon-containing compound of Formula (II) is selected from the group consisting of the following Formulas (II-1), (II-2), and (II-3):

Formula (II-1)

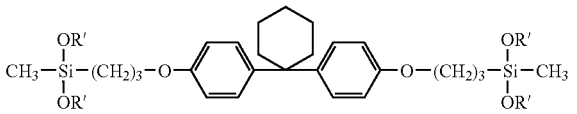

Formula (II-2)

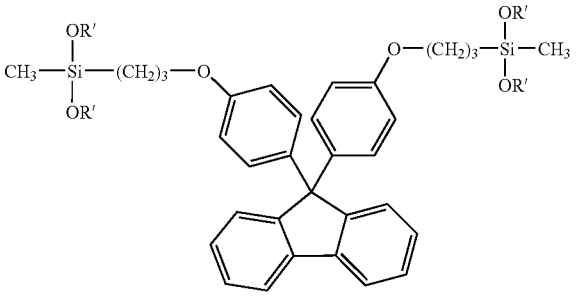

Formula (II-3)

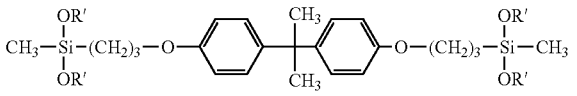

wherein R' is alkyl having from 1 to 4 carbon atoms.

2. The imaging member of claim 1, wherein the perfluoropolyether segment is selected from the group consisting of poly(difluoromethylene oxide), poly(tetrafluoroethylene oxide), poly(hexafluoropropylene oxide), poly(tetrafluoroethylene oxide-co-difluoromethylene oxide), poly(hexafluoropropylene oxide-co-difluoromethylene oxide), and poly(tetrafluoroethylene oxide-co-hexafluoropropylene oxide-co-difluoromethylene oxide).

3. The imaging member of claim 1, wherein the perfluoropolyether segment has a number average molecular weight of from about 100 to about 50,000.

4. The imaging member of claim 1, wherein the perfluoropolyether segment is present in the amount of from about 0.01 to about 10 wt %, based on the total weight of the crosslinked polysiloxane composition.

5. The imaging member of claim 1, wherein G is selected from the group consisting of $—SiE_q(Y)_{3-q}$, and $—(CH_2)_dSiE_q(Y)_{3-q}$, where E is alkyl having from 1 to 6 carbon atoms, q is an integer from 0 to 2, d is an integer from 1 to about 6, and Y is alkoxy having from 1 to 6 carbon atoms.

6. The imaging member of claim 1, wherein X is selected from the group consisting of hydroxyl, alkoxy having from 1 to 6 carbon atoms, acetoxy, and halide.

7. The imaging member of claim 6, wherein X is selected from methoxy, ethoxy, propoxy, or isopropoxy.

8. The imaging member of claim 1, wherein R is selected from the group consisting of alkyl having from 1 to about 6 carbon atoms and phenyl.

9. The imaging member of claim 8, wherein R is selected from methyl or ethyl.

10. The imaging member of claim 1, wherein L is selected from the group consisting of:

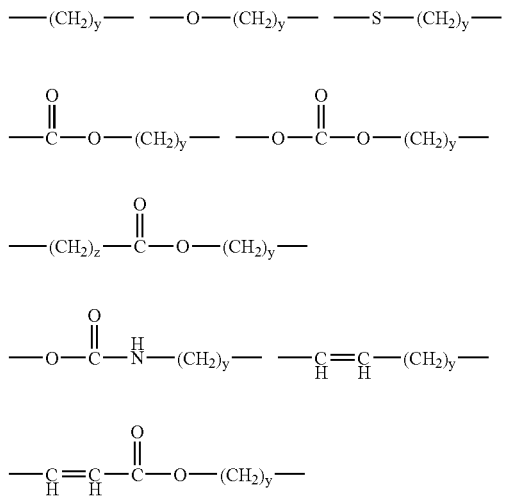

wherein y is an integer from 1 to about 6 and z is an integer from 1 to about 6.

11. The imaging member of claim 1, wherein the aromatic silicon-containing compound of Formula (II) is present in the crosslinked polysiloxane composition in an amount of from about 10 to about 80 wt %, based on the total weight of the crosslinked polysiloxane composition.

12. The imaging member of claim 1, wherein B is a tertiary aromatic amine represented by Formula (IV):

Formula (IV)

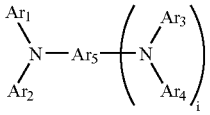

wherein $Ar_1$, $Ar_2$, $Ar_3$, and $Ar_4$ are independently any substituted or unsubstituted aryl group; $Ar_5$ is a substituted or unsubstituted aryl or arylene group; i is 0 or 1; and at least one of $Ar_1$, $Ar_2$, $Ar_3$, $Ar_4$, and $Ar_5$ offers a bonding site to connect with the silyl component of Formula (III).

13. The imaging member of claim 12, wherein the silicon-containing hole transport compound of Formula (III) is selected from the group consisting of:

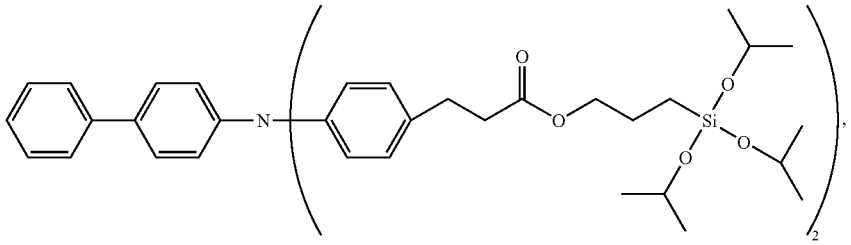

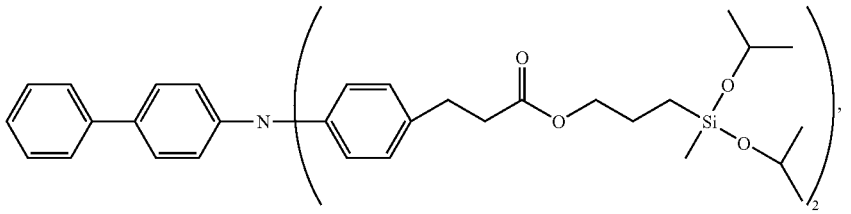

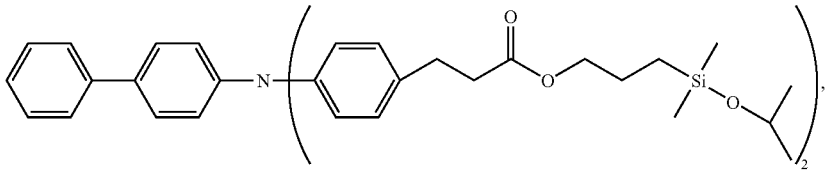

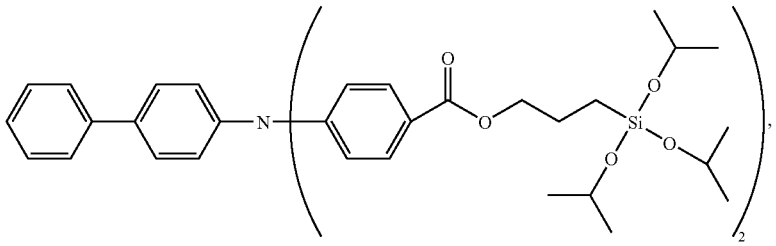

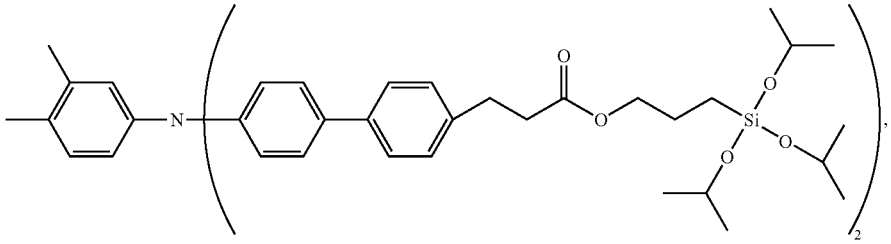

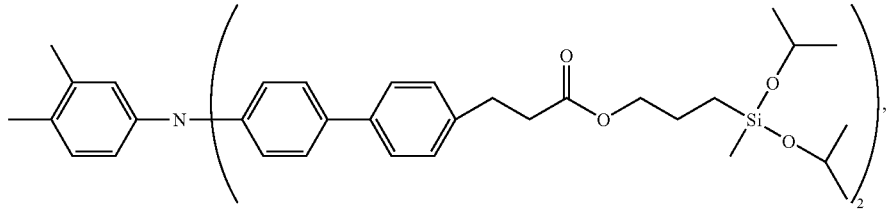

-continued
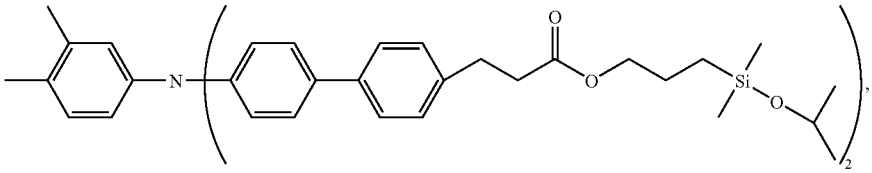
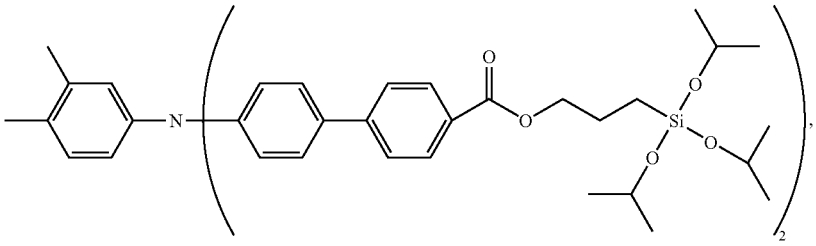
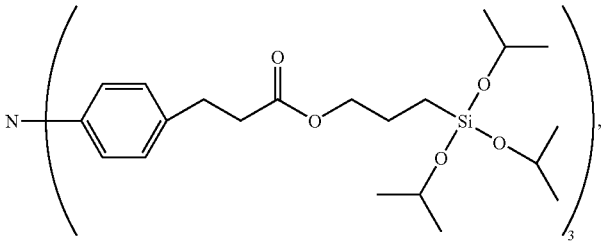
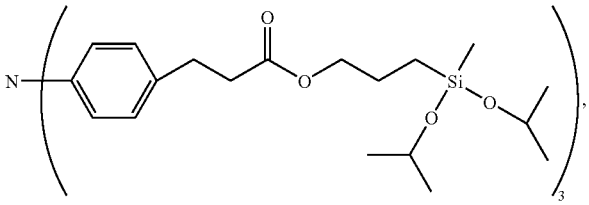
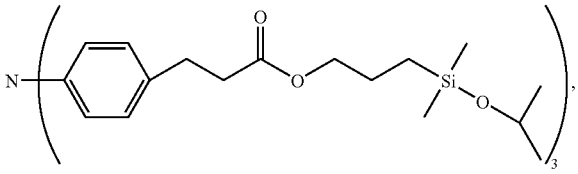
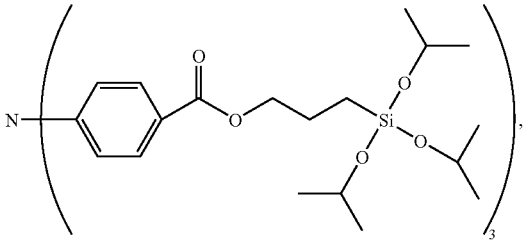
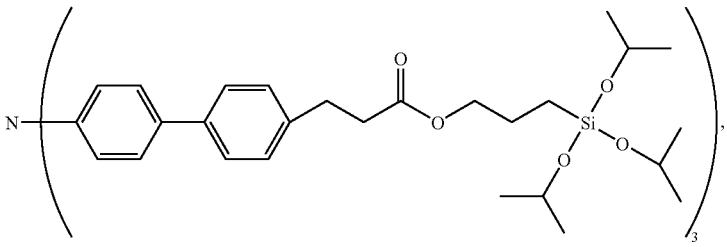

-continued

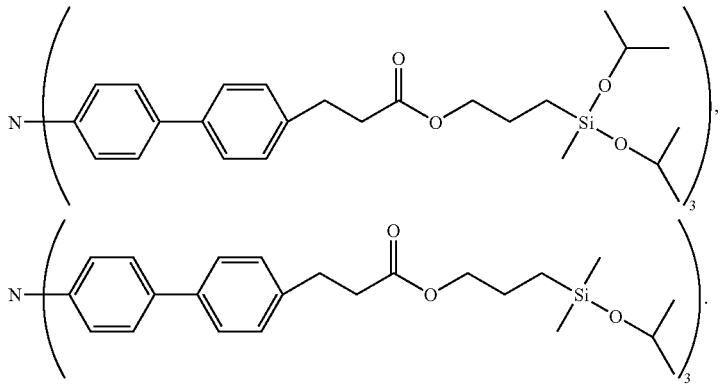

, and

.

14. The imaging member of claim 1, wherein the silicon-containing hole transport compound of Formula (III) is present in the crosslinked polysiloxane composition in an amount from about 20 to about 90 wt %, based on the total weight of the crosslinked polysiloxane composition.

15. An imaging method comprising:

generating a latent electrostatic image on the electrostatographic imaging member of claim 1;

developing the latent image; and transferring the developed electrostatic image to a suitable substrate.

16. An electrophotographic imaging member comprising a substrate, a charge generating layer, a charge transport layer, and a SOC layer;

wherein the SOC layer includes a crosslinked polysiloxane composition which is the product of the hydrolysis and condensation of a SOC formulation comprising:

a perfluoropolyether compound represented by Formula (I):

$$(C_fF_{2f}O)_x[G]_p \qquad \text{Formula (I)}$$

wherein f is an integer from 1 to about 6; x is an integer from about 2 to about 500; G is a functional group connected to the end of the perfluoropolyether chain or grafted to the polymer backbone thereof; p is an integer from 1 to about 100; and G is selected from the group consisting of $—SiE_q(Y)_{3-q}$, and $—(CH_2)_dSiE_q(Y)_{3-q}$, where E is alkyl having from 1 to 6 carbon atoms, q is an integer from 0 to 2, d is an integer from 1 to about 6, and Y is alkoxy having from 1 to 6 carbon atoms;

wherein the perfluoropolyether compound is present in an amount of from about 0.1 to about 3 wt % based on the total weight of the crosslinked polysiloxane composition;

an aromatic silicon-containing compound selected from the group consisting of the following Formulas (II-1), (II-2), and (II-3):

Formula (II-1)

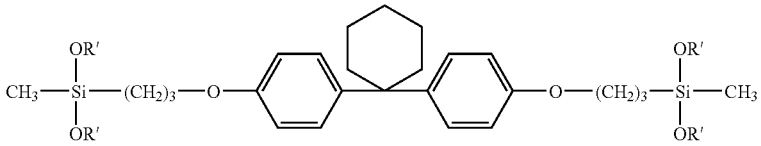

Formula (II-2)

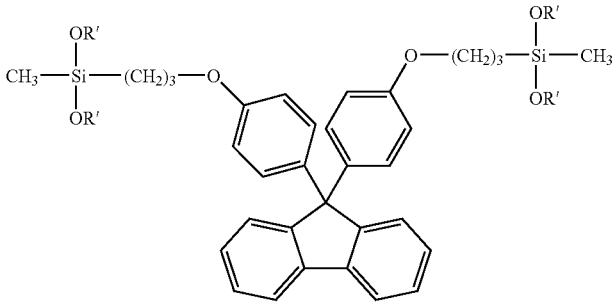

-continued

Formula (II-3)

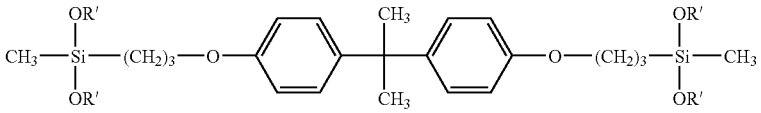

wherein R' is alkyl having from 1 to about 4 carbon atoms; and the aromatic silicon-containing compound is present in an amount of from about 30 to about 70 wt %, based on the total weight of the crosslinked polysiloxane composition; and the silicon-containing hole transport compound represented by Formula (III-1):

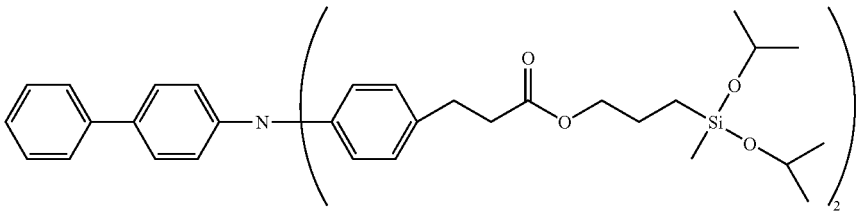

wherein the silicon-containing hole transport compound is present in an amount of from about 40 to about 60 wt %, based on the total weight of the crosslinked polysiloxane composition; and wherein the SOC layer has a thickness of from about 1 micrometer to about 5 micrometers.

* * * * *